US006212696B1

(12) United States Patent
Ray

(10) Patent No.: US 6,212,696 B1
(45) Date of Patent: Apr. 10, 2001

(54) TOILET BOWL WITH IMPROVED ACCESS OPENING

(76) Inventor: Robert C. Ray, 807 Will Vannoy Rd., West Jefferson, NC (US) 28694

( * ) Notice: Subject to any disclaimer, the term of this patent is extended or adjusted under 35 U.S.C. 154(b) by 0 days.

(21) Appl. No.: 09/374,089

(22) Filed: Aug. 12, 1999

(51) Int. Cl.[7] ..... E03D 11/13
(52) U.S. Cl. ..... 4/256.1; 220/234
(58) Field of Search ..... 4/256.1; 215/359; 217/108, 109; 220/234, 238

(56) References Cited

U.S. PATENT DOCUMENTS

| | | | | |
|---|---|---|---|---|
| 918,036 | * | 4/1909 | Gibson | 4/256.1 X |
| 4,303,171 | * | 12/1981 | Schremmer | 220/238 |
| 4,387,825 | * | 6/1983 | Parent | 220/234 |
| 4,942,970 | * | 7/1990 | Jay | 220/234 X |

FOREIGN PATENT DOCUMENTS

| | | | | |
|---|---|---|---|---|
| 152339 | * | 1/1899 | (GB) | 4/256.1 |

* cited by examiner

*Primary Examiner*—Robert M. Fetsuga
(74) *Attorney, Agent, or Firm*—Dale J. Ream

(57) ABSTRACT

An improved toilet bowl construction for providing access to a siphon or trap therein comprises a toilet bowl which defines an opening positioned in communication with the siphon. The toilet bowl construction further includes an annular cover member coupled to a resilient sealing member. The cover member includes a lever pivotally coupled thereto and movable by a user between a first position and a second position displaced from the first position. The lever bears against the resilient sealing member when placed in the second position. The pressure against the sealing member decreases the diameter of the sealing member such that the sealing member can be inserted into the access opening. Returning the lever to the first or non-bearing position allows the diameter of the sealing member to increase and seal tightly within the access opening. Removal of the sealing member is accomplished by again placing the lever in the second or bearing position and withdrawing the sealing member from the opening.

4 Claims, 9 Drawing Sheets

FIG. 4C
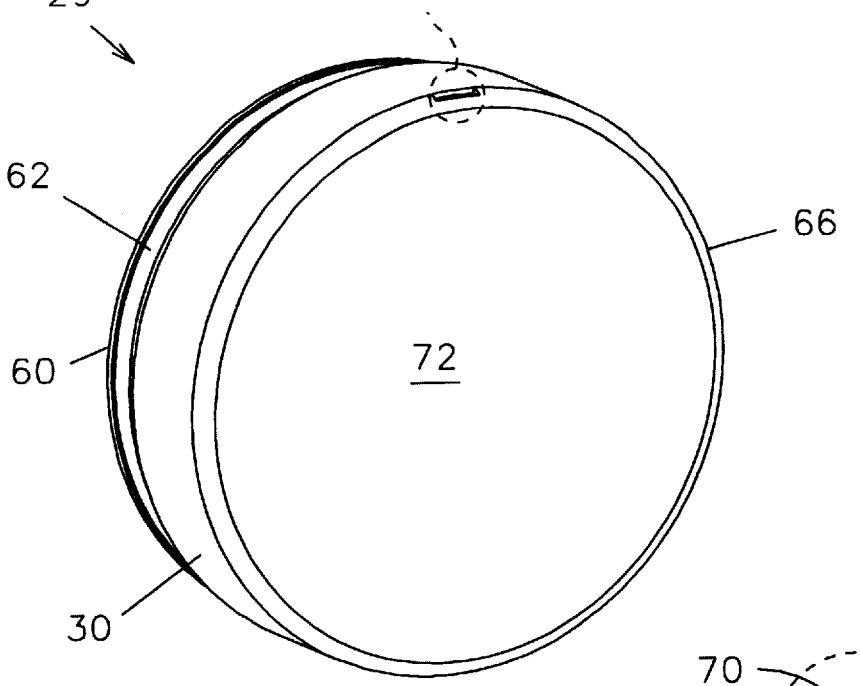
FIG. 4A
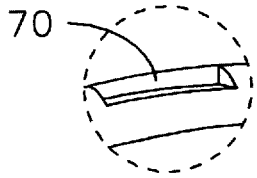
FIG. 4C
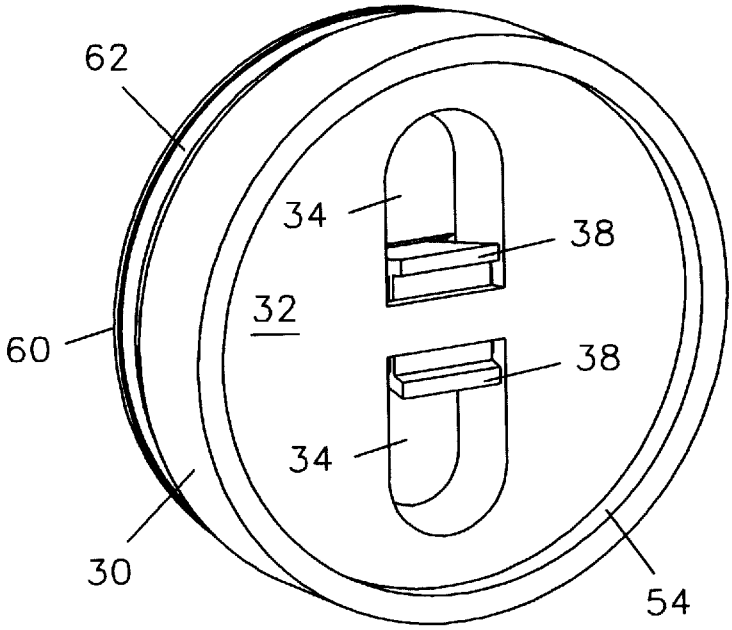
FIG. 4B

TOILET BOWL WITH IMPROVED ACCESS OPENING

BACKGROUND OF THE INVENTION

This invention relates generally to plumbing fixtures and, more particularly, to a convenient access to the trap of a toilet bowl for clearing obstructions therein.

The trap or siphon of a toilet bowl often becomes clogged with a variety of materials, such as children's toys, paper, waste, bathroom articles, or the like. While some obstructions may be dislodged using a plumber's snake, other obstructions cannot be removed except by disconnecting the toilet, dismounting the toilet from the floor, removing the obstruction from the trap, and then remounting the toilet. This procedure is inconvenient, expensive, and may require the assistance of a plumber.

Various toilet bowl constructions have been proposed for providing access to the trap of a toilet bowl for removing an obstruction therefrom, such as those disclosed in U.S. Pat. Nos. 4,376,313 and 3,681,791. While such constructions utilize an opening through the exterior toilet bowl wall, they require the use of one or more fasteners and tools to seal a closure member over the opening. The necessary fasteners and tools may become lost and are inconvenient when an obstruction is desired to be quickly removed.

It is therefore desirable to have a toilet bowl construction which provides direct access to the trap. It is further desirable to have a toilet bowl construction in which the access opening is sealed during normal operation. Finally, it is desirable that the sealing member can be inserted or removed from the access opening without the use of any tools or fasteners.

SUMMARY OF THE INVENTION

Accordingly, the improved toilet bowl construction according to the present invention utilizes a toilet bowl having exterior walls which enclose a siphon or trap therein. The siphon includes an upwardly extending channel connected at an upper end thereof to a downwardly extending channel. The channels are separated by a partition within the toilet bowl. The toilet bowl presents a circular opening through a wall thereof and is positioned to communicate with both the upwardly and downwardly extending channels of the siphon. The opening extends through a side, front, or rear wall of the toilet bowl depending upon the particular configuration of the siphon therein.

The improved toilet bowl construction further includes an annular cover member having a lever extending therethrough. The lever is pivotally coupled to the cover member and is movable between a first position and a second position displaced from the first position. A resilient sealing member having an annular configuration substantially similar to the cover member is coupled thereto. The diameter of the sealing member is slightly larger than the diameter of the access opening. The lever bears against a central hub on the sealing member when the lever is placed in the second position. A user movement of the lever to a position bearing against the sealing member causes the diameter of the sealing member to decrease sufficiently so as to allow the sealing member to be inserted into the access opening. Releasing the lever to its first non-bearing position allows the diameter of the sealing member to increase so as to tightly seat within the access opening. A user may remove the sealing member from the access opening by again moving the lever to the position bearing against the sealing member and then extracting the sealing member from the opening.

It is therefore a general object of this invention to provide a toilet bowl construction which provides access to a trap or siphon positioned internally therein.

Another object of this invention is to provide a toilet bowl construction, as aforesaid, which provides access to both upwardly and downwardly flowing channels of the trap.

Still another object of this invention is to provide a toilet bowl construction, as aforesaid, having a sealing member which covers and seals the access opening during normal operation.

Yet another object of this invention is to provide a toilet bowl construction, as aforesaid, in which the sealing member is held within the access opening without the use of fasteners.

A further object of this invention is to provide a toilet bowl construction, as aforesaid, in which the sealing member can be inserted into or removed from the access opening without the use of tools.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 4A is a front perspective view of the sealing assembly ;

FIG. 4B is a perspective view as in FIG. 4A with the cap removed from the closure member;

FIG. 4C is an enlarged view of the means for releasing the protective cap from the cover member;

DESCRIPTION OF THE PREFERRED EMBODIMENT

Figure 1:
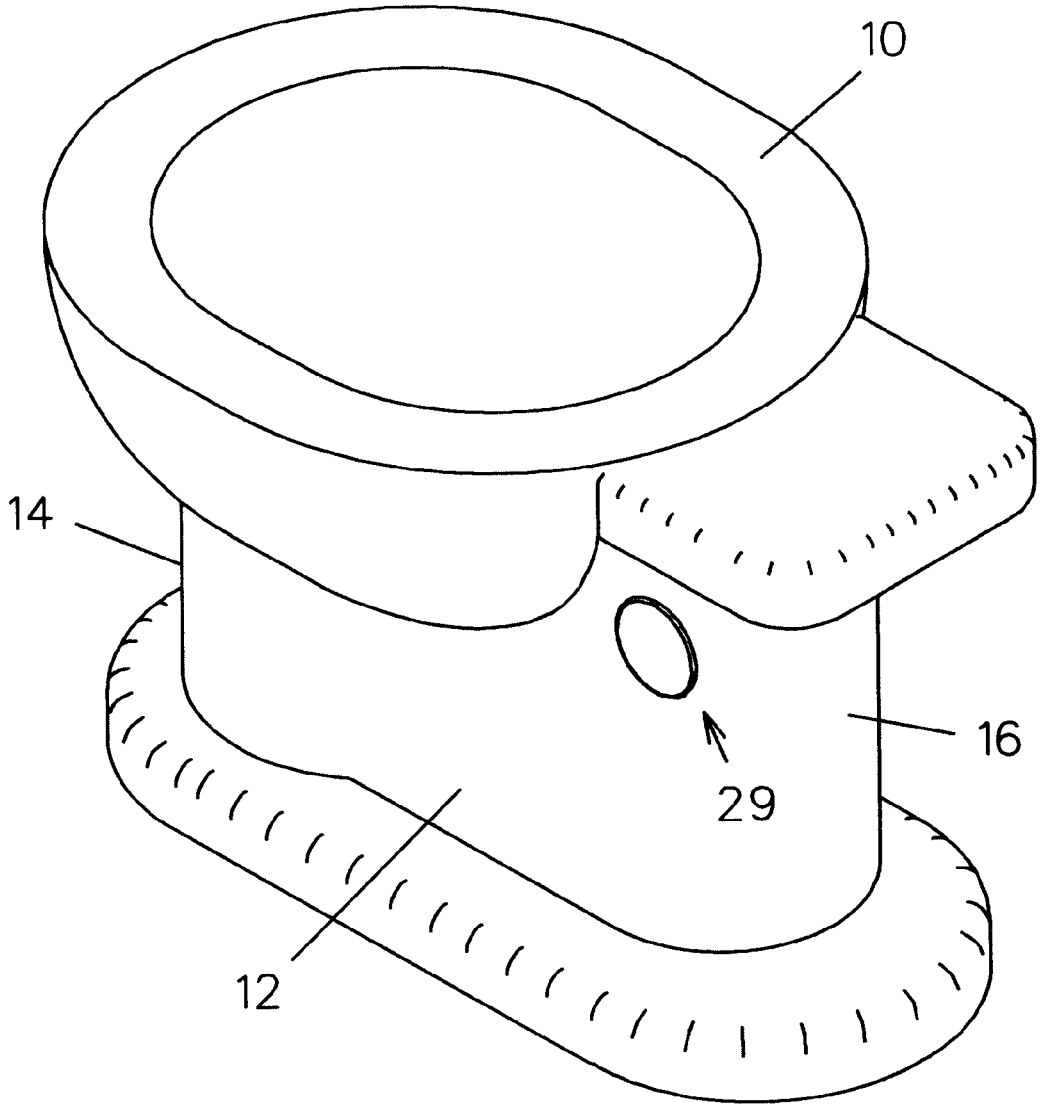
FIG. 1 is a perspective view of the improved toilet bowl construction according to the present invention.
Figure 2:
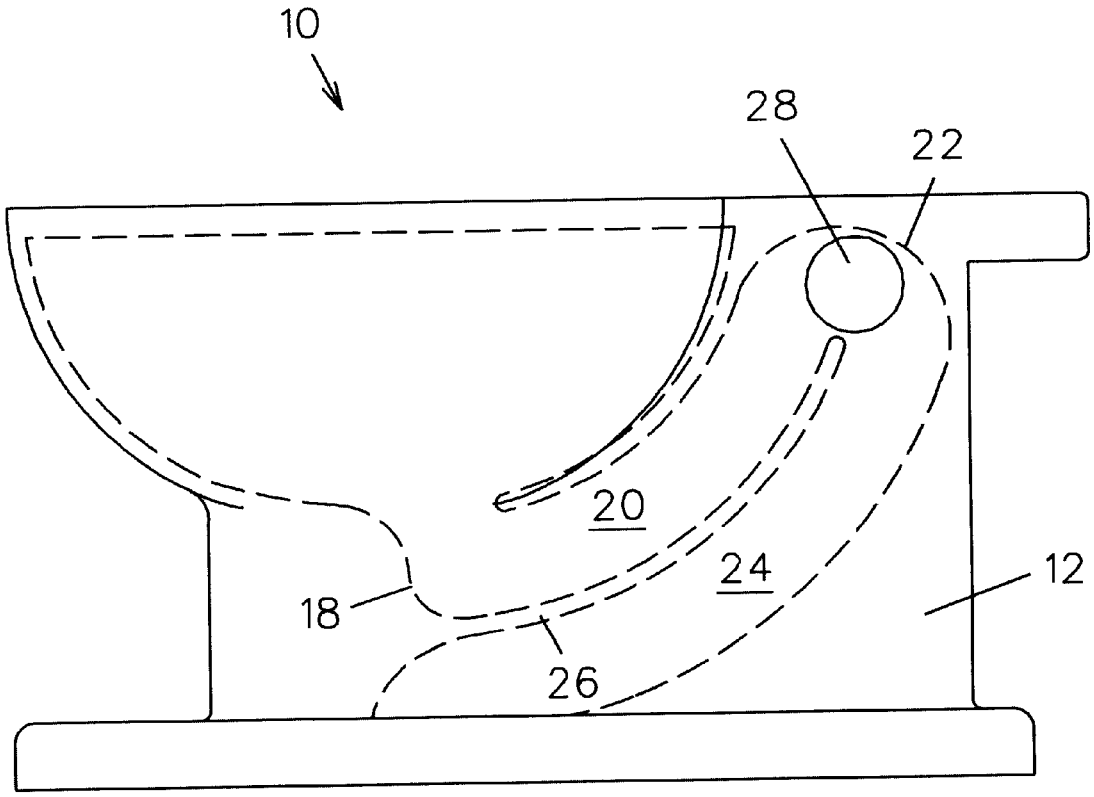
FIG. 2 is a side view of the toilet bowl construction as in FIG. 1.
Figures 3, 6:
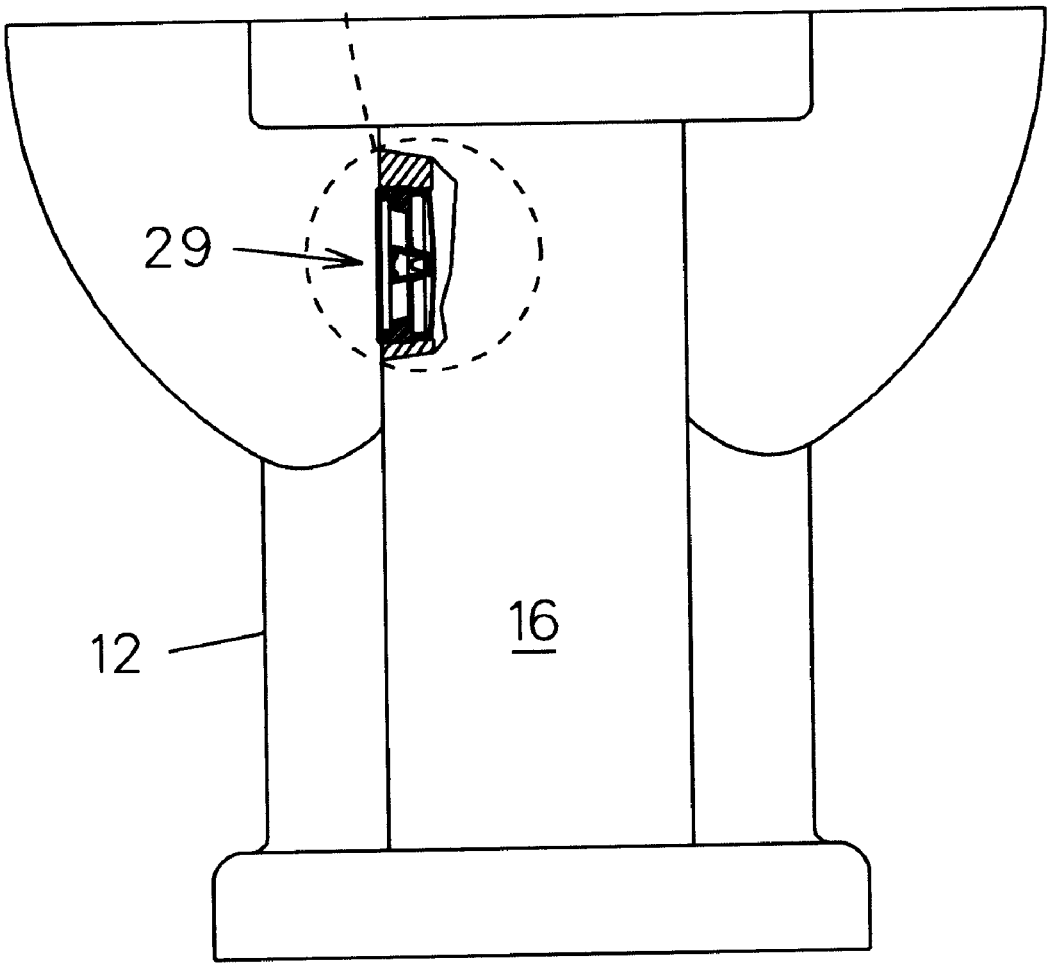
FIG. 3 is a rear view of the toilet bowl construction as in FIG. 1 with a portion of the rear wall broken away to show the sealing assembly.

Turning more particularly to the drawings, FIGS. 1 and 2 show an improved toilet bowl construction according to the present invention. The improved construction includes a toilet bowl 10 or commode having external front 14, side 12, and rear 16 walls. The toilet bowl 10 includes a siphon 18 or trap extending within the rear portion of the toilet bowl 10. The siphon 18 includes an upwardly extending channel 20 which is connected at its uppermost end 22 to a downwardly extending channel 24. An inner wall or partition 26 separates the upwardly extending channel 20 from the downwardly extending channel 24 except at the upper end 22 thereof.

A circular access opening 28 extends through a side wall 12 of the toilet bowl 10 and communicates with the siphon 18 therein. The opening 28 is positioned at the upper end 22 so as to communicate with both the upwardly 20 and downwardly 24 extending channels of the siphon 18. Thus, obstructions in any portion of the siphon 18 may be removed through the access opening 28. It is understood that while the opening 28 extends through a side wall 12 of the toilet bowl illustrated in FIGS. 1 and 2, the opening may extend through the front 14 or rear 16 wall depending on the particular construction of the toilet bowl.

Figure 9:
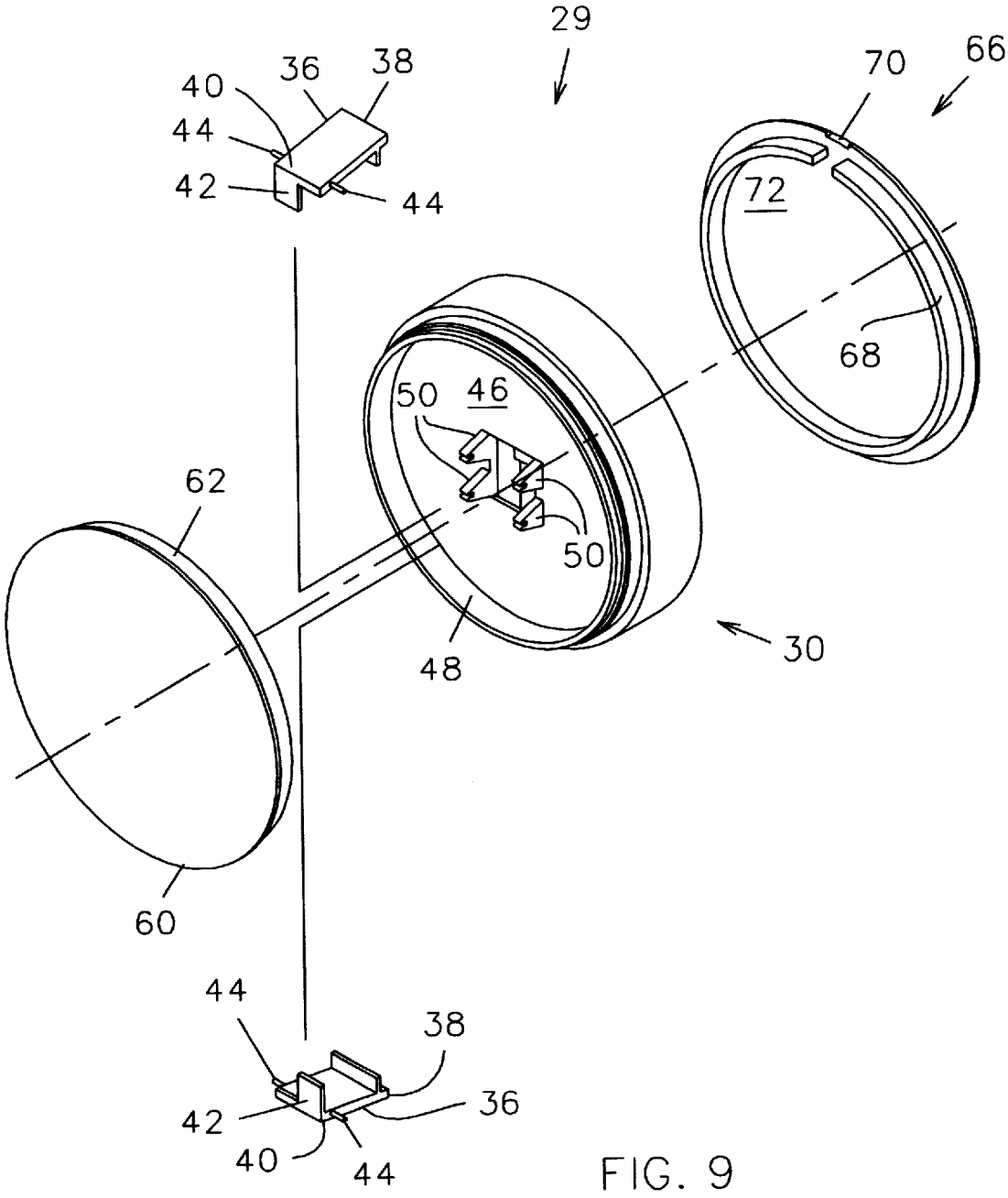
FIG. 9 is an exploded view of the sealing assembly of FIG. 7A.

With reference to FIG. 9, the improved toilet bowl construction further includes a sealing assembly 29 having a cover member 30, a sealing member 60, and a cap 66. The cover member 30 presents a generally annular configuration. An exterior side 32 of the cover member 30 defines a pair of spaced apart recesses 34, each recess 34 being large enough to receive the finger or thumb of a person therein (FIG. 4B). The cover member 30 further includes an interior side 46 having a rim 48 extending thereabout to form an interior space. Two pair of spaced apart brackets 50 are mounted to the interior side 46 of the cover member 30 (FIG. 9).

Figure 5A:
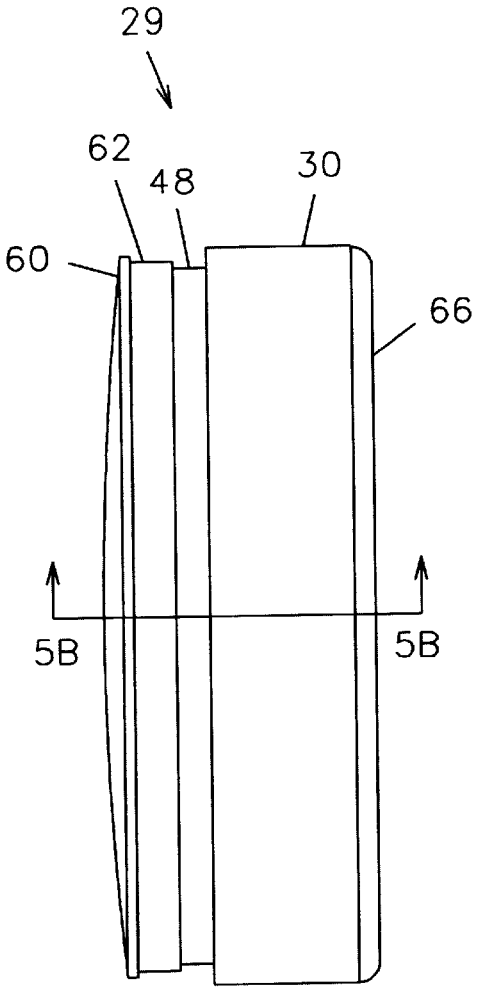
FIG. 5A is a side view of the sealing assembly of FIG. 4A.
Figure 5B:
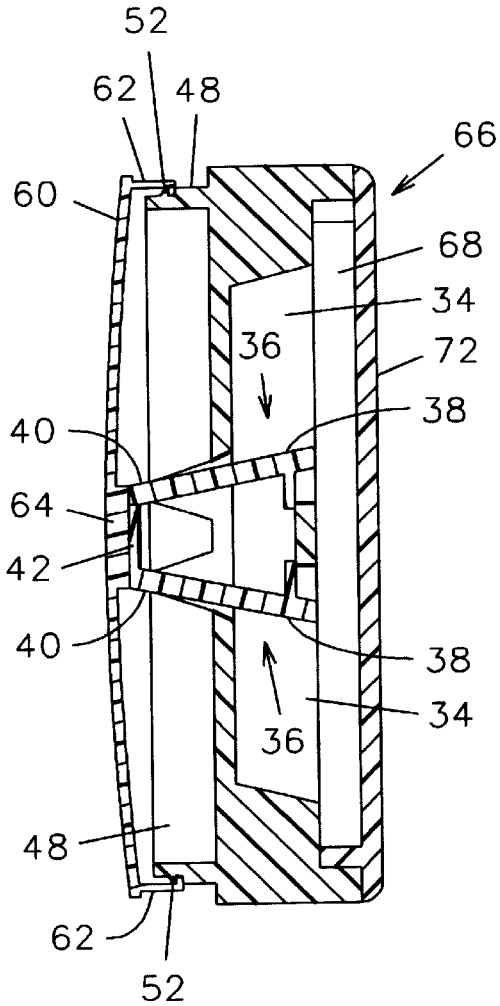
FIG. 5B is a sectional view of the sealing assembly taken along line 5B—5B of FIG. 5A.

A pair of levers 36 extend through the cover member 30 (FIG. 5B). Each lever 36 includes a first end 38 which extends into a respective recess 34 in the exterior side 32 of the cover member 30 (FIGS. 4B and 5B). Each lever 36 further includes a second end 40 which extends into the interior space of the interior side 46 of the cover member 30. An axle 44 is integrally connected to the second end 40 of each lever 36 and is pivotally coupled to a pair of brackets 50. Each axle 44 is therefore a pivot axis for a respective lever 36. Each lever 36 is freely pivotal thereabout upon movement of the first end 38 by a user.

Each lever 36 further includes a flange 42 integral connected to the second end 40 thereof. In a first position, each flange 42 is parallel to the interior side 46 of the cover member (FIG. 7B) while free ends of said flanges 42 are displaced from the interior side 46 when the levers 36 are pivoted to a second position (FIG. 8).

Figure 6B:
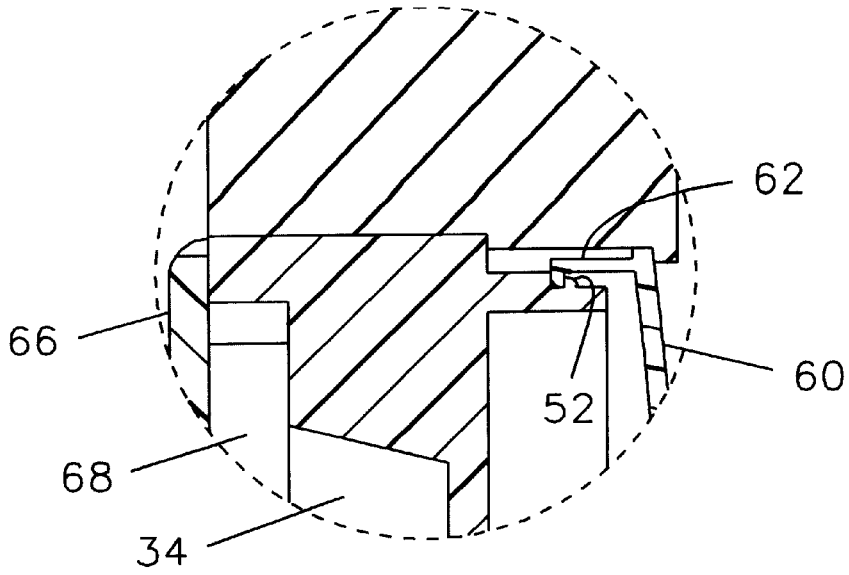
FIG. 6B is an enlarged view of the attachment of the sealing member to the cover member.
Figure 6A:
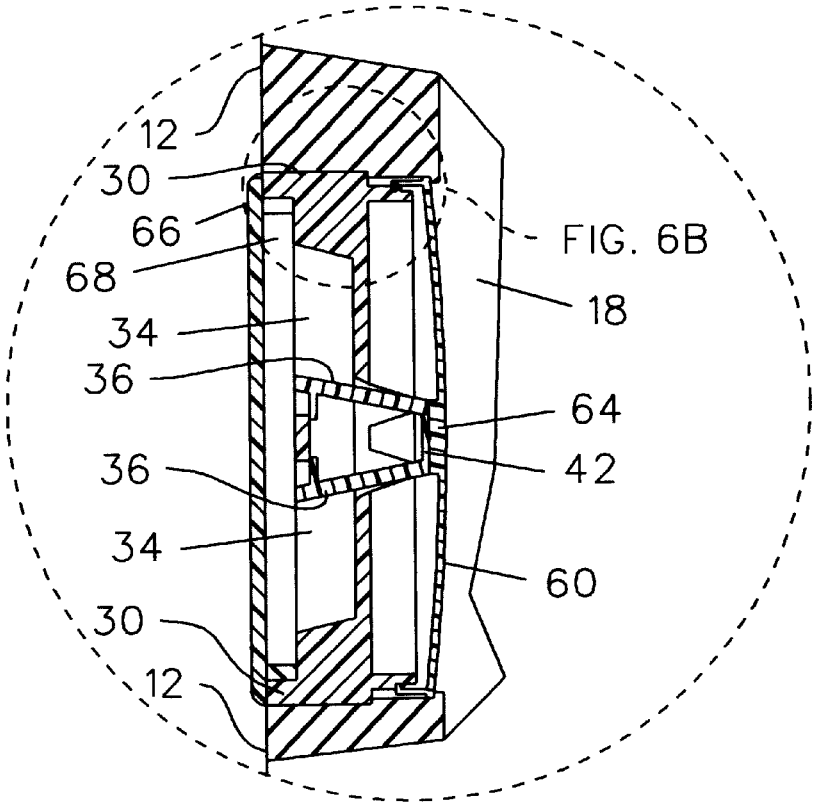
FIG. 6A is an enlarged view of the sealing assembly inserted into the access opening as in FIG. 3.

The sealing member 60 includes a rim 62 having a diameter slightly greater than the diameter of the cover member rim 48. The sealing member 60 is securely coupled to the cover member 30 by frictionally fitting the sealing member rim 62 over nubs 52 extending from the cover member rim 48 (FIG. 6B). The sealing member 60 further includes a hub 64 concentrically mounted on the interior side 46 thereof and extending therefrom (FIG. 5B). In the first position (FIG. 7B), the flanges 42 are adjacent to the hub 64, whereas the flanges 42 bear against the hub 64 when placed in the displaced position (FIG. 8). The sealing member 60 is formed of a resilient material, such as a thin plastic material, such that the diameter thereof is decreased as the hub 64 is pushed outwardly by the flanges 42. More particularly, the sealing member rim 62 grips the cover member rim 48 more tightly as the hub 64 is outwardly extended, thus decreasing the diameter of the sealing member 60.

Another rim 54 extends about the exterior side 32 of the cover member (FIGS. 4B and 9). The cap 66 also includes a rim 68 presenting a diameter slightly smaller than the diameter of the cover member rim 54 such that the cap 66 may be releasably coupled to the cover member 30 in a friction fit relationship (FIG. 5B). The rim 68 of the cap 66 presents a notch 70 adapted to receive a screwdriver or the like therein for separating the cap 66 from the cover member 30 (FIG. 4C). A wall 72 completely extends between the edges of the rim 68 such that access to the levers 36 of the cover member 30 is prevented when the cap 66 is coupled thereto.

In operation, the access opening 28 is covered by the sealing assembly 29 when access to the siphon 18 of the toilet bowl 10 is not desired. To insert and seat the sealing member 60 into the opening 28, a user depresses the first end 38 of one or both levers 36 which extend into the recesses 34 of the cover member 30. Preferably, the levers 36 are simultaneously depressed by squeezing the levers 36 together with the thumb and fingers of a user's hand. Depression of first ends 38 causes the levers to pivot such that the flanges 42 on the second ends 40 of the levers 36 bear against the hub 64 of the resilient sealing member 60. As the hub 64 is outwardly extended, the diameter of the sealing member is decreased to facilitate insertion of the sealing member 60 into the access opening 28.

Figure 7A:
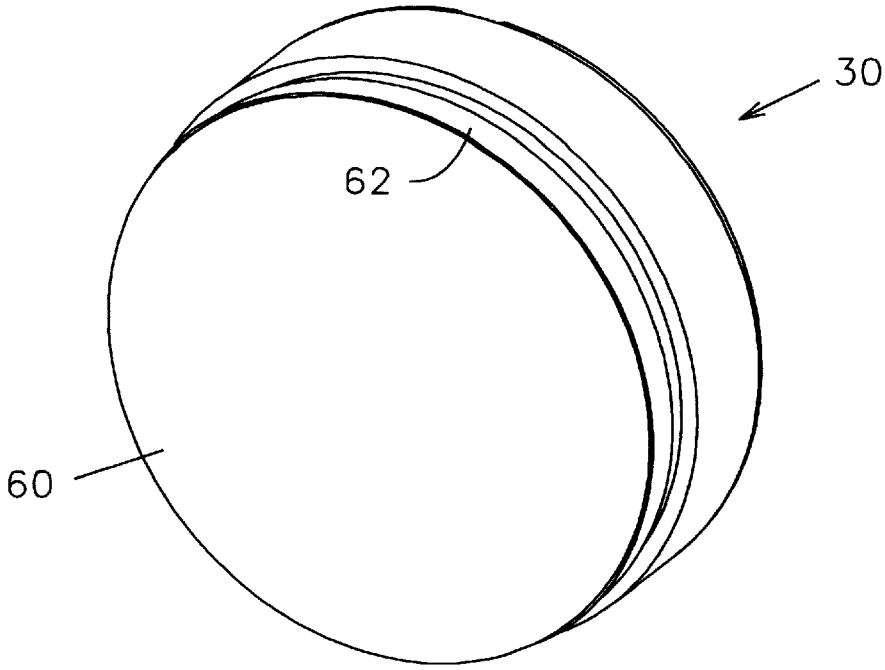
FIG. 7A is a rear perspective view of the sealing assembly.
Figure 7B:
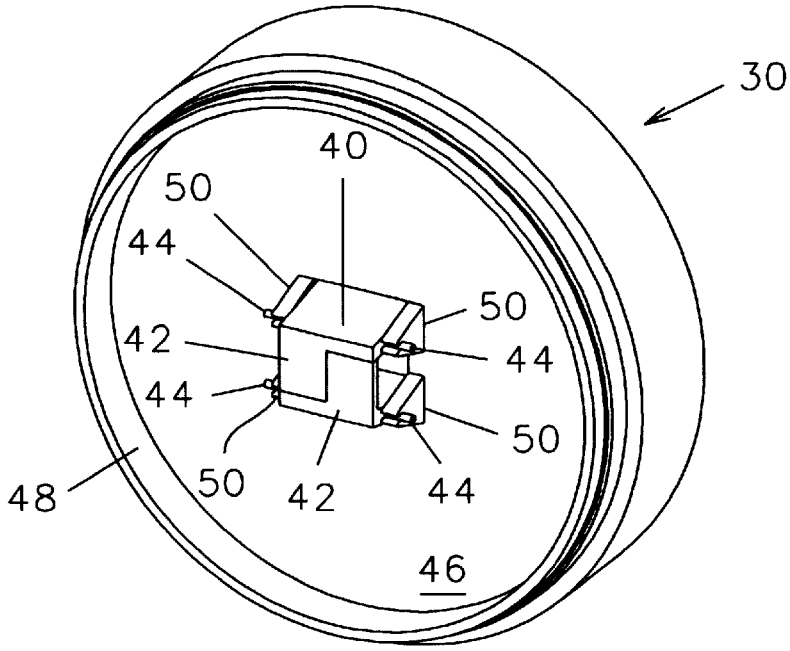
FIG. 7B is a perspective view of the sealing assembly as in FIG. 7A with the sealing member removed and with the levers in a first non-extended configuration.
Figure 8:
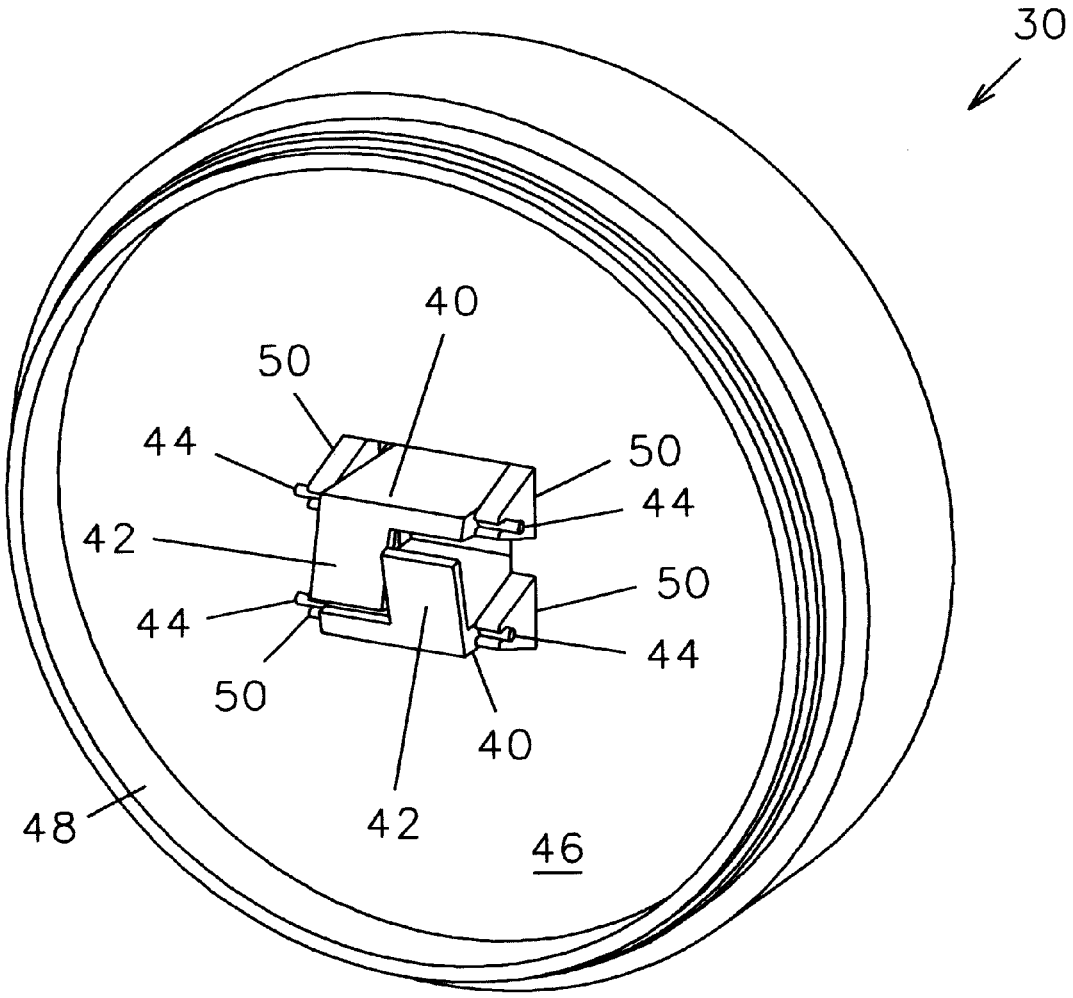
FIG. 8 is a perspective view as in FIG. 7B on an enlarged scale with the levers in a second extended configuration.

A release of the lever first ends 38 causes the levers to pivot to a non-bearing position (FIG. 7B). In turn, the diameter of the sealing member 60 increases to create a tight seal within the opening 28. The cap 66 may then be frictionally mounted to the cover member 30 so as to prevent inadvertent movement of the levers 36 which may result in leakage from the toilet bowl 10.

When access to the siphon 18 is desired, the sealing assembly may be removed from the access opening 28 in a manner similar to that required for insertion. The cap 66 is removed from the cover member 30. The first ends 38 of the levers 36 are squeezed together to pivot the levers 36 and force the flanges 42 to bear against the hub 64 of the sealing member 60. With the levers 36 in a bearing position (FIG. 8), the diameter of the sealing member 60 is decreased, allowing the sealing assembly 29 to be extracted from the opening 28.

Accordingly, it can be seen that the improved toilet bowl construction provides convenient access to the siphon or trap of a commode without the use of tools or fasteners.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An improved toilet bowl construction, comprising:

a toilet bowl having front, side, and rear wall portions with a siphon internally positioned therein, said siphon presenting an upwardly flowing channel connected to a downwardly flowing channel at an upper end thereof, said channels separated by a partition;

a circular opening through said side wall portion of said toilet bowl and positioned adjacent said upper end for communication with said upwardly and downwardly flowing channels;

an annular cover member having a lever pivotally coupled thereto, said lever selectably pivotal between a first position and a second position displaced from said first position;

a resilient sealing member coupled to said cover member and having an annular configuration, said sealing member having a diameter slightly greater than a diameter of said opening, said sealing member selectively insertable into said opening when said lever is pivoted to said second position in which said lever bears against said sealing member for selectively decreasing said diameter of said sealing member; and a cap having a diameter slightly smaller than a diameter of said cover member said cap being releasably coupled to said cover member in a friction fit relationship for covering said lever and preventing undesired removal of said sealing member from said opening.

2. A toilet bowl construction as in claim 1 where in said cover member comprises:

an exterior side defining a recess adapted to receive one of a user's fingers therein, a first end of said lever extending into said recess;

an interior side defining an interior space, a second end of said lever extending into said interior space; and a bracket positioned in said interior space, said lever being pivotally coupled to said bracket, whereby said lever is pivotally movable between said first and second positions upon a user movement of said first end of said lever.

3. A toilet bowl construction as in claim 1 wherein said sealing member includes a circular hub extending concentrically therefrom adjacent said lever when said lever is placed in said first position, said lever bearing against said hub when said lever is placed in said second position.

4. An improved toilet bowl construction as in claim 1, wherein said cap includes a rim having a diameter slightly smaller than a diameter of a rim of said cover member, said cap rim adapted to be releasably coupled to said cover member rim in a friction fit relationship, said cap rim defining a notch adapted to receive a screwdriver therein for separating said cap from said cover member.

* * * * *